US010160102B2

(12) United States Patent
Huang

(10) Patent No.: US 10,160,102 B2
(45) Date of Patent: Dec. 25, 2018

(54) JAW WRENCH

(71) Applicant: Yu-Shiang Huang, Taichung (TW)

(72) Inventor: Yu-Shiang Huang, Taichung (TW)

( * ) Notice: Subject to any disclaimer, the term of this patent is extended or adjusted under 35 U.S.C. 154(b) by 250 days.

(21) Appl. No.: 15/361,486

(22) Filed: Nov. 27, 2016

(65) Prior Publication Data

US 2017/0209987 A1 Jul. 27, 2017

(30) Foreign Application Priority Data

Jan. 22, 2016 (TW) ..... 105101948 A

(51) Int. Cl.
*B25B 13/28* (2006.01)
*B25B 23/00* (2006.01)
*B25B 13/50* (2006.01)

(52) U.S. Cl.
CPC ..... *B25B 13/28* (2013.01); *B25B 23/0028* (2013.01); *B25B 13/5016* (2013.01)

(58) Field of Classification Search
CPC .. B25B 13/28; B25B 13/5016; B25B 23/0028
USPC ..... 81/177.8, 177.6, 177.7
See application file for complete search history.

(56) References Cited

U.S. PATENT DOCUMENTS 8,511,207 B2 * 8/2013 Su ..... B25G 1/06 254/25
8,708,312 B2 * 4/2014 Stawarski ..... B25G 1/06 192/69
9,616,555 B2 * 4/2017 Chartier ..... B25B 13/481
2010/0186557 A1 * 7/2010 Hsieh ..... B25B 23/0028 81/177.8

* cited by examiner

*Primary Examiner* — David B Thomas

(57) ABSTRACT

A jaw wrench includes two first bodies, a second body a function end unit and a control unit. The first bodies each have a first toothed hole. The second body has a second toothed hole. The function unit includes a third body and a fourth body pivotably connected to the third body. The third body has a first toothed portion and is connected to the second body. The fourth body has a second toothed portion. An object is clamped between the first and second toothed portions. The control unit has two control members, two second resilient members and two covers. The two control members extend into the two first and second bodies and each have a third toothed hole which is engaged with the first/second toothed hole. When the control members are pushed, the third toothed holes are disengaged from the first toothed hole.

8 Claims, 13 Drawing Sheets

JAW WRENCH

BACKGROUND OF THE INVENTION

1. Fields of the Invention

The present invention relates to a jaw wrench, and more particularly, to a jaw wrench that is able to open wide to clamp larger objects.

2. Descriptions of Related Art

The conventional jaw wrench known to applicant is disclosed in U.S. Pat. No. 2,825,254, and generally comprises a basic structure, a movable jaw member and a lever rod. The basic structure includes a neck and multiple sockets. The movable jaw member has the neck and is able to move linearly relative to the neck by the adjusting member so as to adjust the relative position between the first jaw and the second jaw. The lever rod is connected to one of the sockets so that when the user holds the lever rod, the jaw wrench is adjust a better position to rotate an object. However, there are only three sockets for the basic structure, and the diameter of each of the sockets and the size of the basic structure are limited, so that the relative angular position between the lever rod and the basic structure is restricted by the limited number of the sockets.

The present invention intends to provide a jaw wrench which improves the shortcomings of limited relative position between the basic structure and the lever rod mentioned above.

SUMMARY OF THE INVENTION

The present invention relates to a jaw wrench and comprises two first bodies, a second body a function end unit and a control unit. The first bodies each have a first toothed hole, and a first room is defined between the two first bodies. The second body has a second toothed hole. The function unit includes a third body and a fourth body pivotably connected to the third body. The third body has a first toothed portion and is connected to the second body. The fourth body has a second toothed portion. An object is clamped between the first and second toothed portions. The control unit has two control members, two second resilient members and two covers. The two control members extend into the two first and second bodies and each have a third toothed hole which is engaged with the first/second toothed hole. When the control members are pushed, the third toothed holes are disengaged from the first toothed hole. The covers are connected to the two first bodies so as to restrict the control members and the second resilient members.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
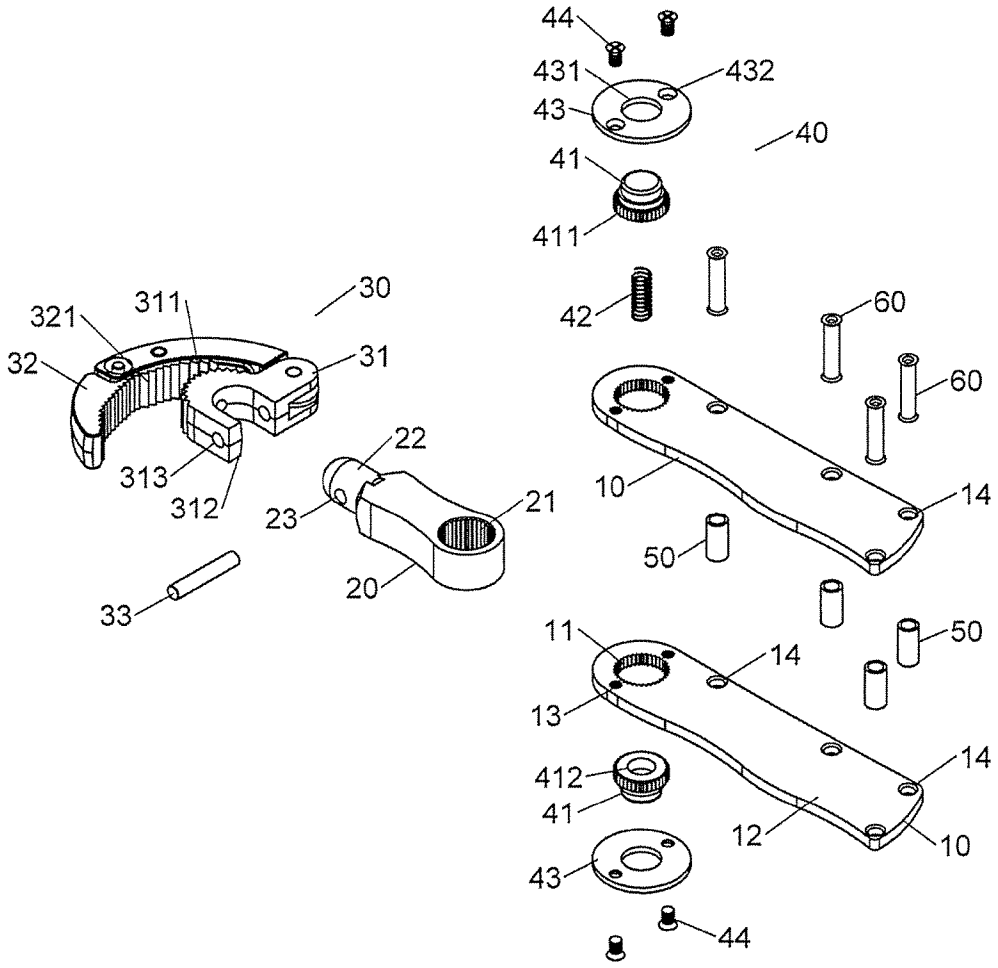
FIG. 1 is an exploded view of the jaw wrench of the present invention.
Figure 2:
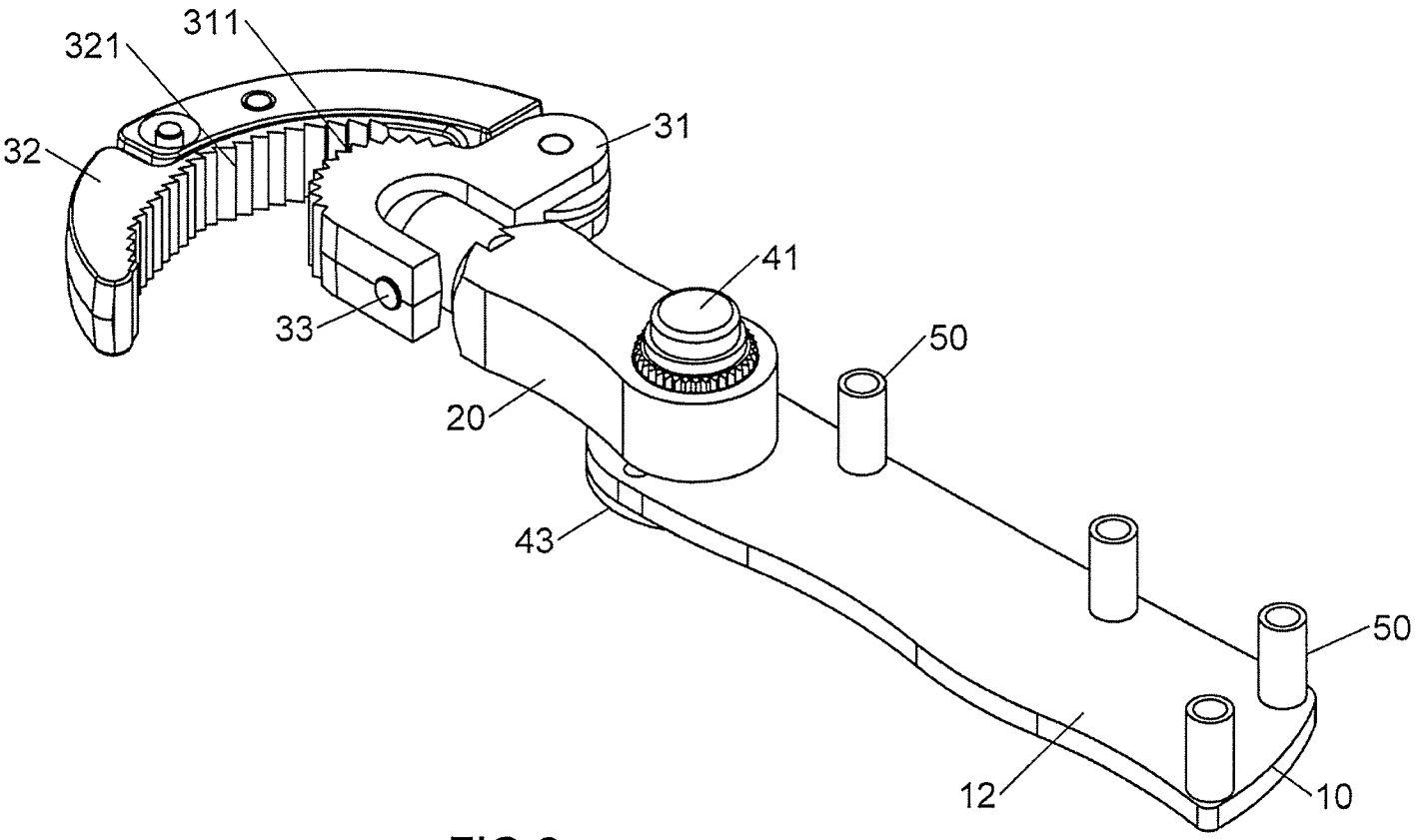
FIG. 2 shows a portion of the jaw wrench of the present invention.
Figure 3:
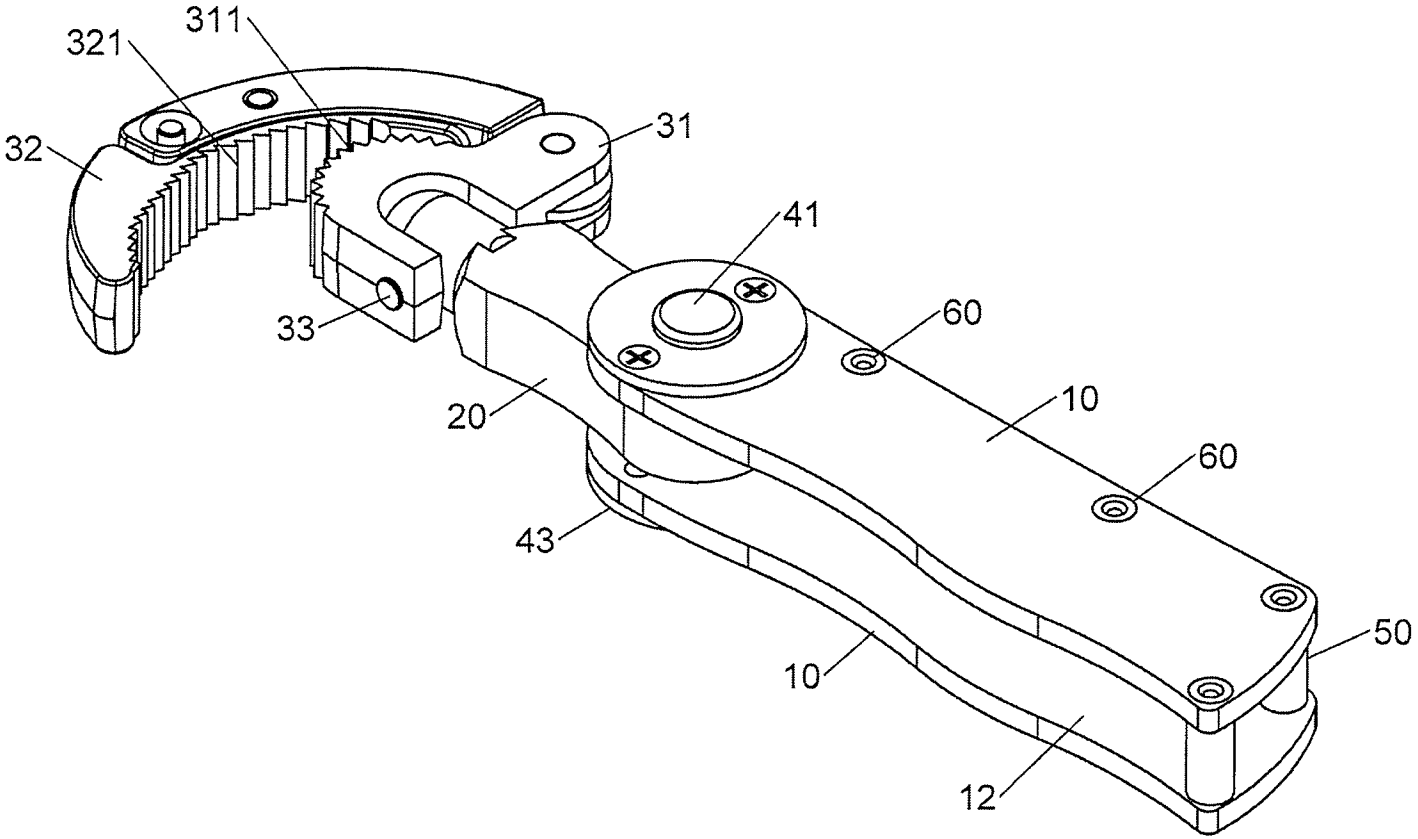
FIG. 3 is a perspective view to show the jaw wrench of the present invention.

Referring to FIGS. 1 to 3, the jaw wrench comprises two first bodies 10, a second body 20, a function end unit 30, a control unit 40 multiple tubes 50 and multiple first fixing members 60. Each first body 10 has four fixing holes 14 and the four fixing holes 14 are located along edges of the first body 10 corresponding thereto. A first toothed hole 11 is defined in the first end of each of the first bodies 10. A first room 12 is defined between the two first bodies 10. Two threaded holes 13 are located close to the first toothed hole 11. The second body 20 has a second toothed hole 21 defined in the first end thereof, and the second toothed hole 21 is located between the two first toothed holes 11 of the two first bodies 10. A first pivotal portion 22 is defined in the second end of the second body 20. The number of each of the first toothed holes 11 is the same as that of the second toothed hole 21. The first pivotal portion 22 has a first pivotal hole 23. The two first bodies 10 are symmetric relative to the second body 20.

The function end unit 30 is pivotably connected to the second body 20, and has a U-shaped third body 31, a curved fourth body 32 and a cylindrical pin 33. The third body 31 has a second pivotal hole 313, a second pivotal portion 312 and a first toothed portion 311 which is defined along a curved face. The second pivotal portion 312 is pivotably connected to the first pivotal portion 22. the second pivotal portion 312 is located on an opposite side of the first toothed portion 311. The second pivotal hole 313 is pivotably connected to the first pivotal hole 23. The third body 31 is pivotable an angle relative to the second body 20 about the second pivotal hole 313. The second pivotal hole 313 communicates with the second pivotal portion 312. The fourth body 32 has a first end thereof pivotably connected to the first end of the third body 31. The fourth body 32 has a second toothed portion 321 defined in a curved face. The second toothed portion 321 faces the first toothed portion 311. The first toothed portion 311 and the second toothed portion 321 clamp an object therebetween. The pin 33 extends through the first pivotal hole 23 and the second pivotal hole 313 to pivotably connect the second body 20 to the function end unit 30.

The control unit 40 has two control members 41, a second resilient member 42, two covers 43 and fourth screws 44. The two control members 41 are respectively received in the first and second bodies 10, 20. The two control members 41 are located symmetric relative to the second body 20. Each control member 41 has a third toothed hole 411 defined in the outside thereof. Each of the third toothed holes 411 is engaged with the first and second toothed holes 11, 21. Each control member 41 has a recess 412, and the second resilient members 42 are received in the two respective recesses 412. The second resilient member 42 biases the third toothed hole 411 of the control member 41 corresponding thereto to be engaged with the first toothed hole 11/the second toothed hole 21. When the two control members 41 are pushed to move linearly, the second resilient members 42 are compressed, and each of the third toothed holes 411 is disengaged from the first toothed hole 11 corresponding thereto, and the second toothed hole 21 is still engaged with the third toothed holes 411. The covers 43 are connected to the two first bodies 10 and restrict the control members 41 and the second resilient member 42. Each cover 43 has a first circular hole 431 and two second circular holes 432. The two control members 41 respectively and partially extend through the two first circular holes 431 so that the user can easily push the control members 41. Each second circular hole 432 is located corresponding to one of the threaded holes 13. The two covers 43 are respectively located on two respective outsides of the two first bodies 10 and symmetric to the second body 20. The screws 44 extend through the second circular holes 432 and are threadedly connected to the threaded holes 13 to fix the covers 43 to the first bodies 10.

The tubes 50 are connected between the two first bodies 10 so as to define the first room 12 between the two first bodies 10. Each tube 50 is located corresponding to the fixing hole 14 corresponding thereto. The number of the tubes 50 is the same as that of the fixing holes 14.

The fixing members 60 extend through the fixing holes 14 of the first bodies 10 and the tube 50 to connect the two bodies 10 to each other. The second fixing members 70 are rivets or threading members. The number of the first fixing members 60 is the same as that of the fixing holes 14.

Figure 4:
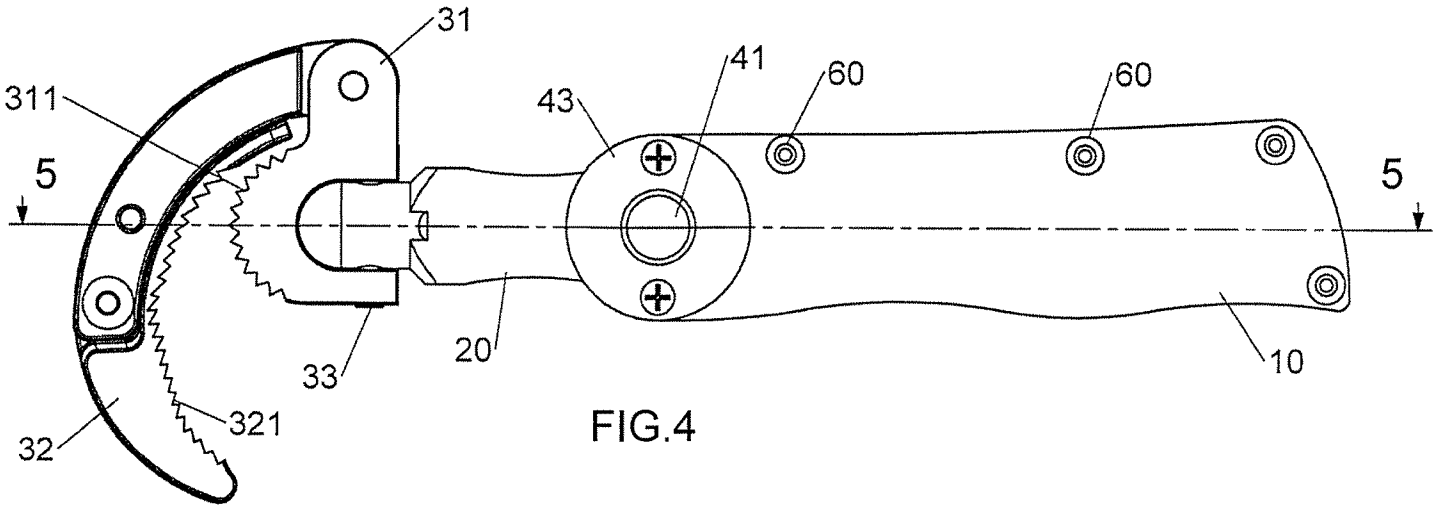
FIG. 4 is a top view of the jaw wrench of the present invention.
Figure 5:
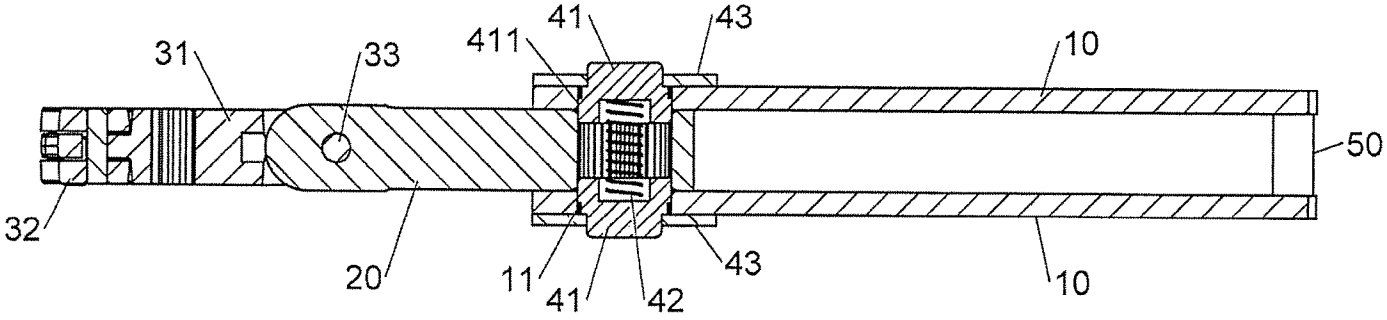
FIG. 5 is a cross sectional view, taken along line 5-5 of FIG. 4.

As shown in FIGS. 4 and 5, the second body 20 is located between the two first bodies 10, and the function end unit 30 is connected to the first pivotal hole 23 and the second pivotal hole 313. The third body 31 and the fourth body 32 are connected to each other. The pin 33 extends through the first and second pivotal holes 23, 313 to pivotably connect the function end unit 30 to the second body 20. The third toothed holes 411 are engaged with the first toothed holes 11 and the second toothed hole 21. Each of the second resilient members 42 is received in the recess 412 of the control member 41 corresponding thereto. The four screws 44 connect the two covers 43 to the first bodies 10 to restrict the two control members 41 and the two second resilient members 42 from dropping from the first bodies 10. The four tubes 50 are located between the two first bodies 10 and located corresponding to the fixing holes 14. The four first fixing members 60 are connected to fixing holes 14 of the two first bodies 10 to connect the two first bodies 10.

Figure 6:
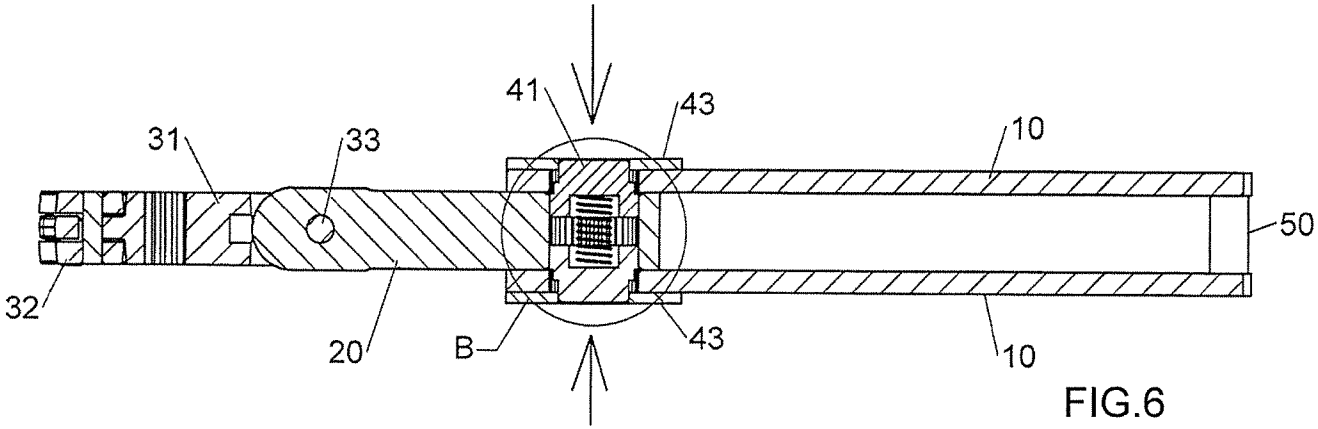
FIG. 6 shows that the control members are pushed inward.
Figure 7:
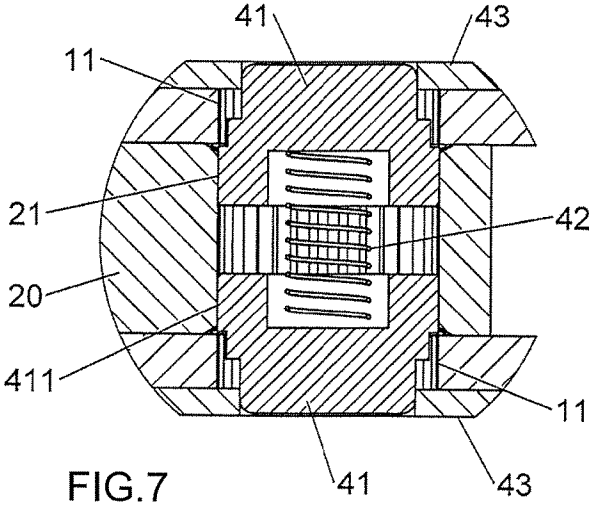
FIG. 7 is an enlarged cross sectional view of the circled portion "B" in FIG. 6.
Figure 8:
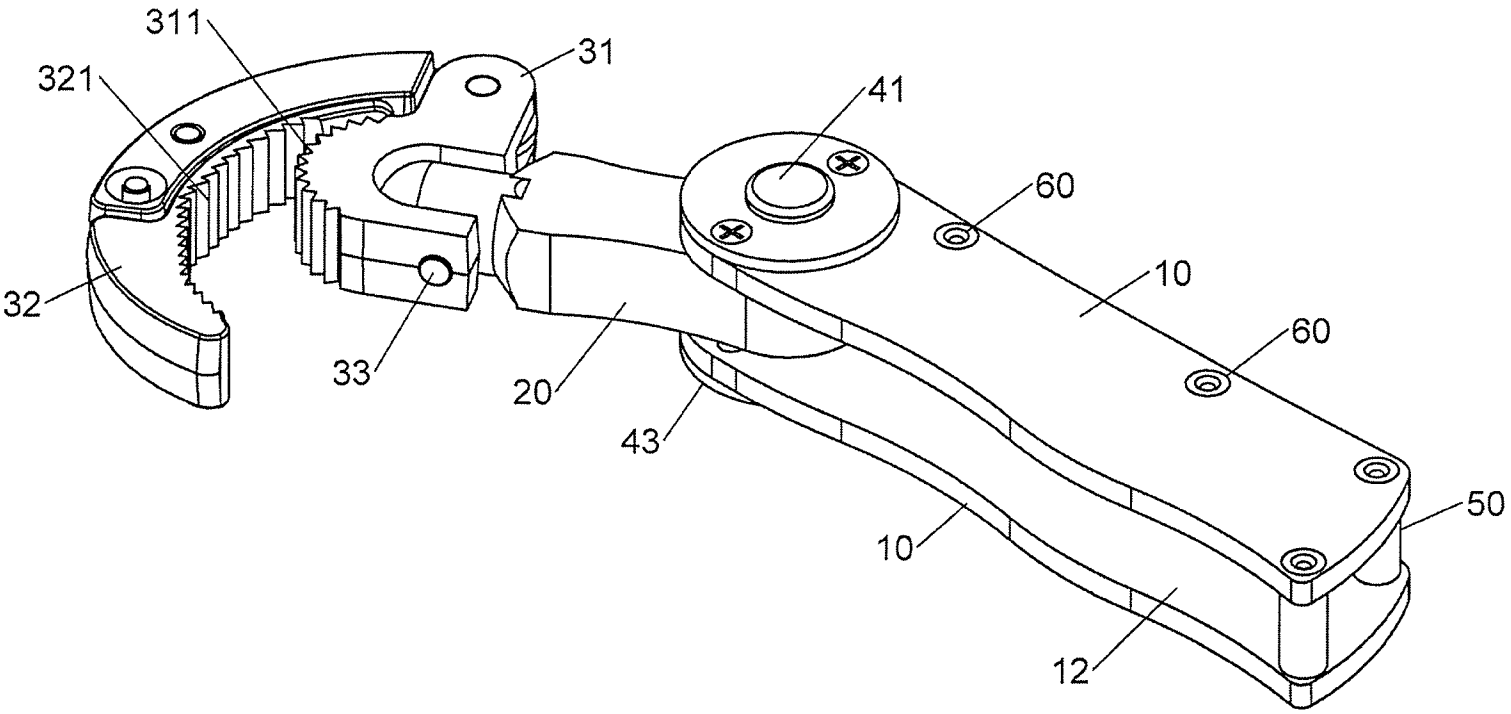
FIG. 8 shows that the second body is pivoted an angle relative to the first bodies.

As shown in FIGS. 6 to 8, the two control members 41 are pushed linearly and simultaneously to compress the second resilient members 42, and the third toothed holes 411 are disengaged from the first toothed holes 11 and are still engaged with the second toothed hole 21. The second body 20 can be pivoted to adjust the relative position between the first and second bodies 10, 20. After the relative position between the first and second bodies 10, 20 is adjusted, as shown in FIG. 8, the two control members 41 are released, the second resilient members 42 push the two control members 41 backward, and the relative position between the first and second bodies 10, 20 is set.

Figure 9:
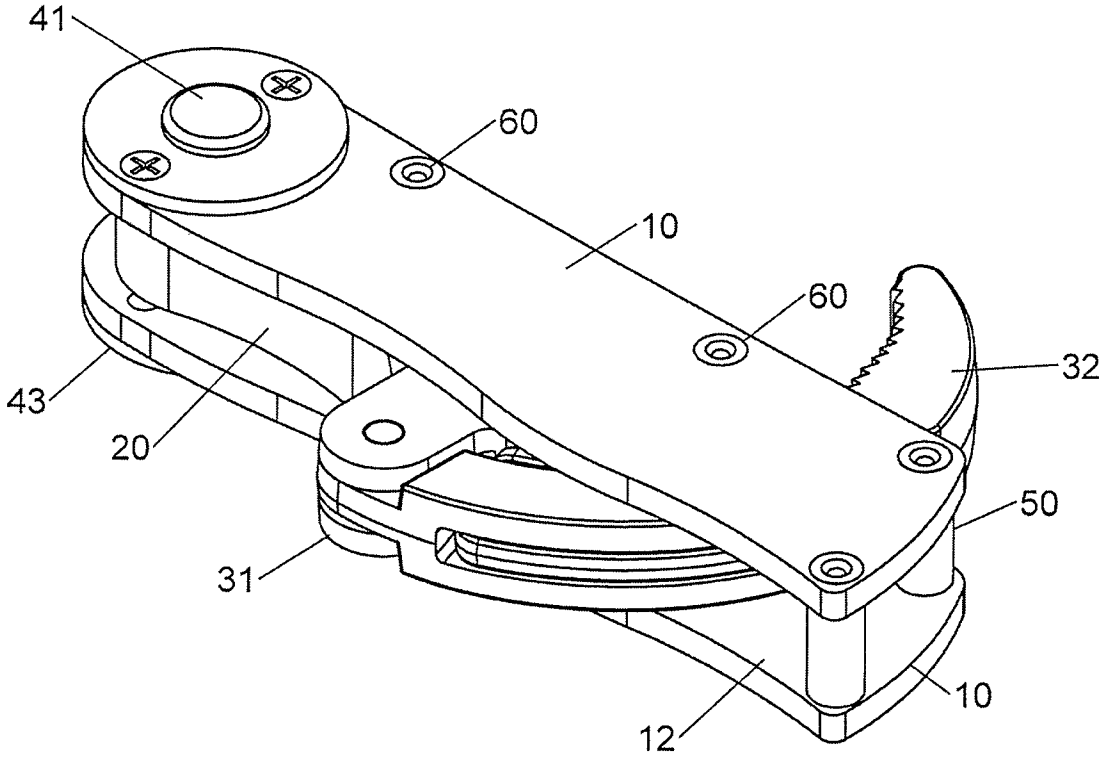
FIG. 9 shows that the jaw wrench of the present invention is folded.

As shown in FIG. 9, when the two control members 41 are pushed linearly and simultaneously, the function end unit 30 and the second body 20 are pivoted to be received in the first room 12 such that the jaw wrench is in its folded status which saves room for storage.

Figure 10:
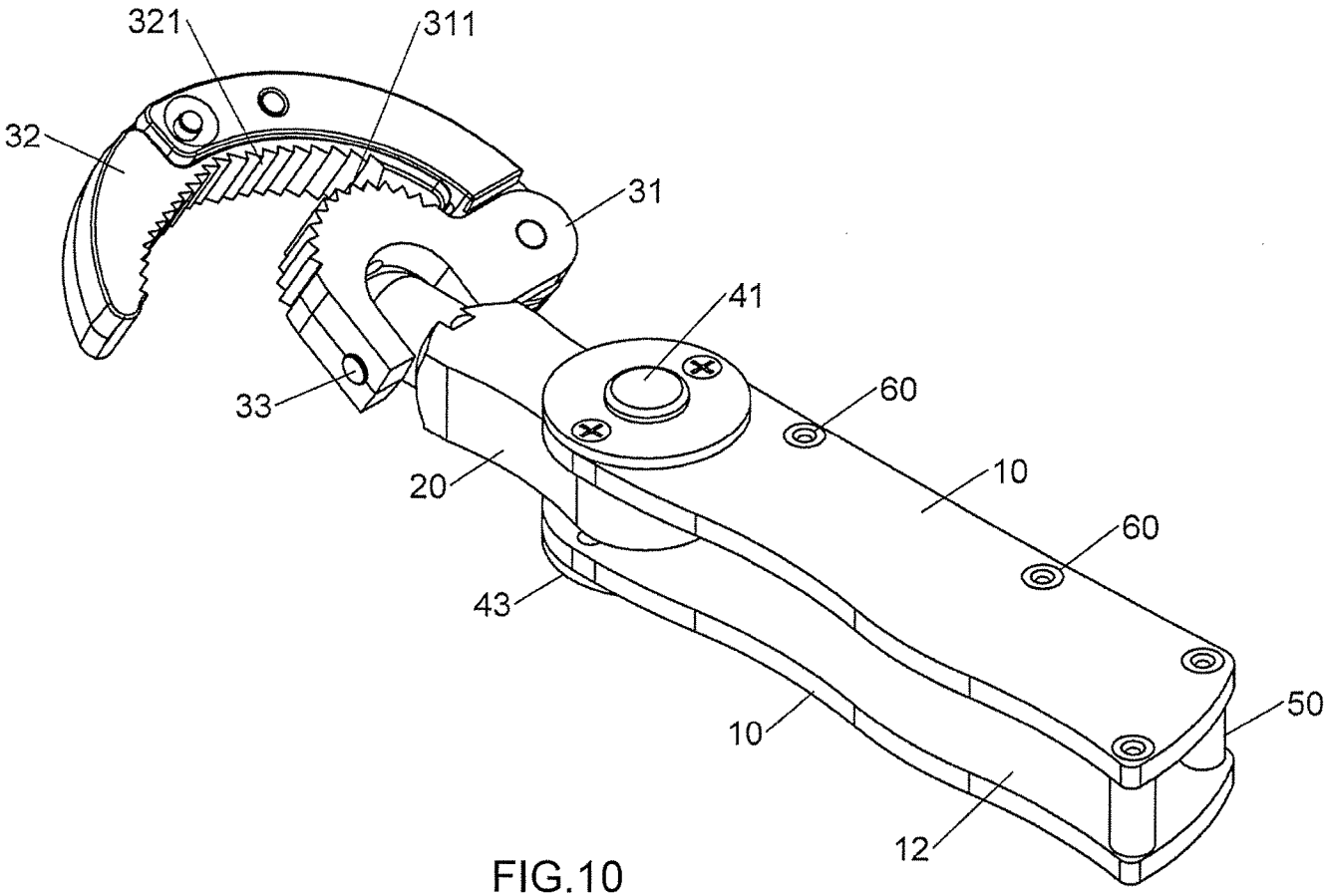
FIG. 10 shows that the second body and the function unit are pivoted relative to each other.

As shown in FIG. 10, the second body 20 is pivotably connected to the function end unit 30, and the first pivotal portion 22 is pivotably connected to the second pivotal portion 312, The pin 33 extends through the first pivotal hole 23 and the second pivotal hole 313, so that the function end unit 30 can be pivoted an angle about the pin 33 relative to the second body 20. The function end unit 30 can be adjusted its angular position relative to the second body 20.

Figure 11:
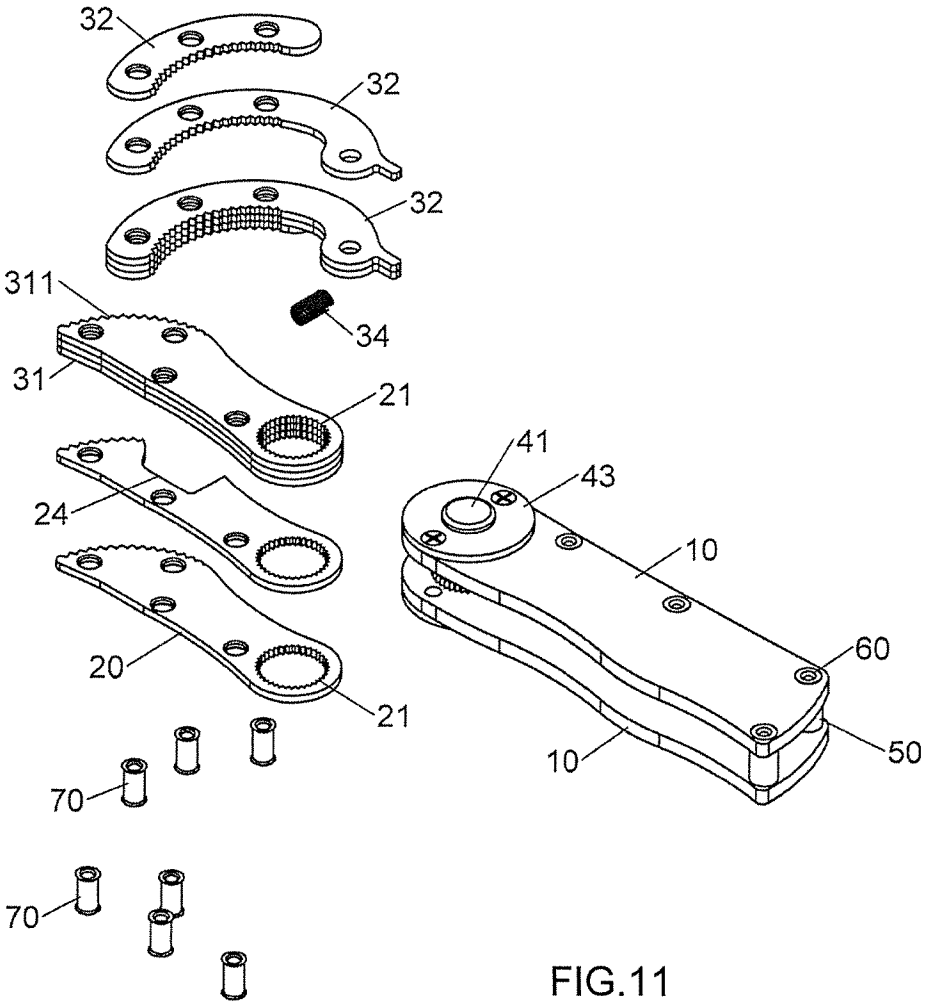
FIG. 11 is an exploded view of the second embodiment of the jaw wrench of the present invention.
Figure 12:
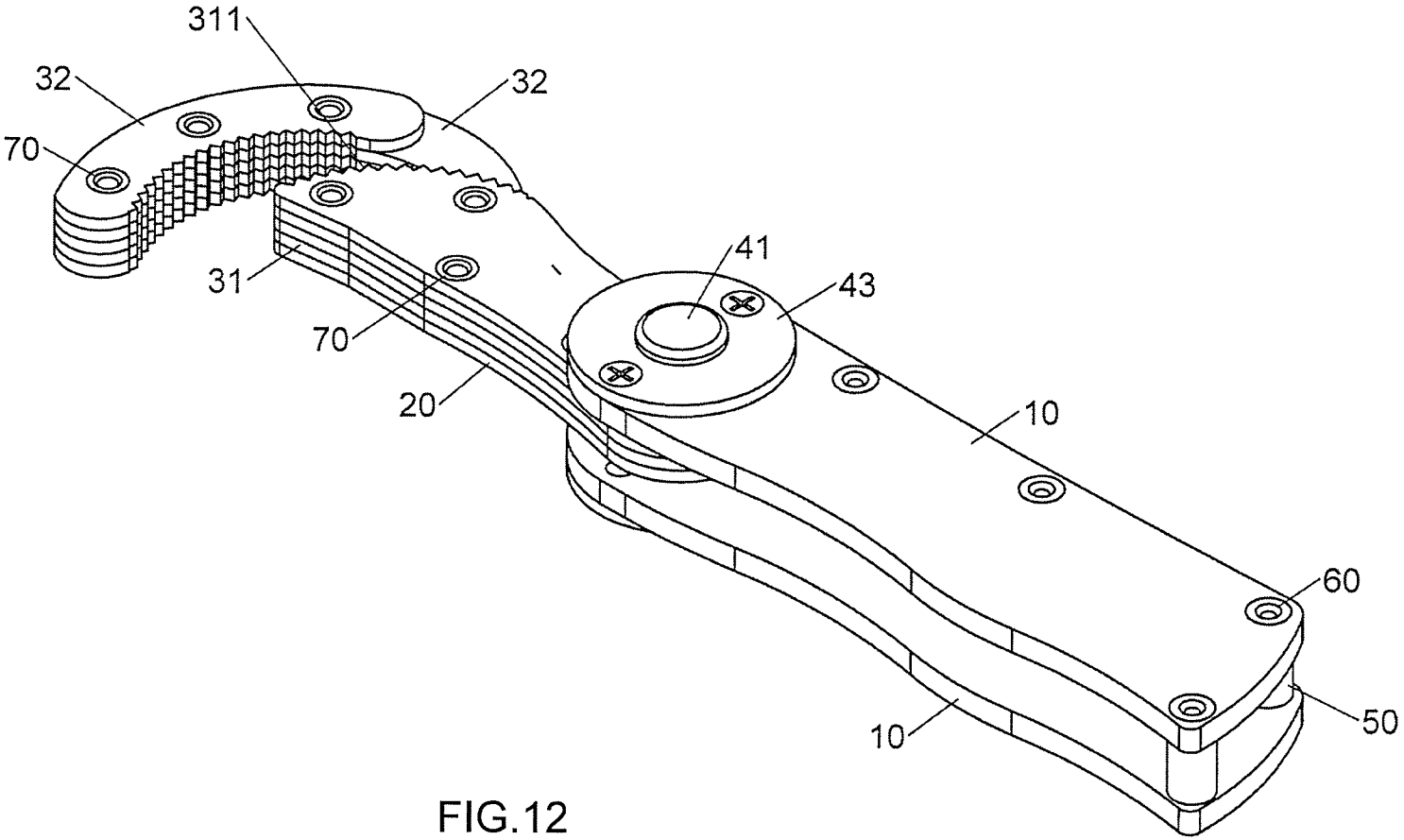
FIG. 12 is a perspective view to show the second embodiment of the jaw wrench of the present invention.

As shown in FIGS. 11 and 12, this embodiment shows that each of the second and third bodies 20, 31 are composed multiple plates, and one of the plates that is located at the middle of the second body 20 includes a second room 24 which is a recess. Each of the second body 20 and the third body 31 has multiple first installation units, wherein the plate that has the second room 24 that is a recess has three first installation units. The rest of the plates of the first and third bodies 20, 31 each have four first installation units. Each first installation unit is a hole and located corresponding to each other. The fourth body 32 is composed of multiple plates and pivotably connected to the second body 20 and the third body 31. The fourth body 32 has third pivotal holes. The third pivotal holes are located corresponding to one of the first installation units. Each plate of the fourth body 32 has three second installation units which are holes, the second installation units of the plates of the fourth body 32 are located corresponding to each other. A first resilient member 34 is received in the second room 24 and biased between the second body 20 and the fourth body 32. Four second fixing members 70 extend through the first installation units of the second body 20 and the third body 31 to connect the second body 20 to the third body 31. Three second fixing members 70 are connected to the second installation units of each plate of the fourth body 32 to connect the plates to form the fourth body 32. The second fixing members 70 are rivets or threading members.

Figure 13:
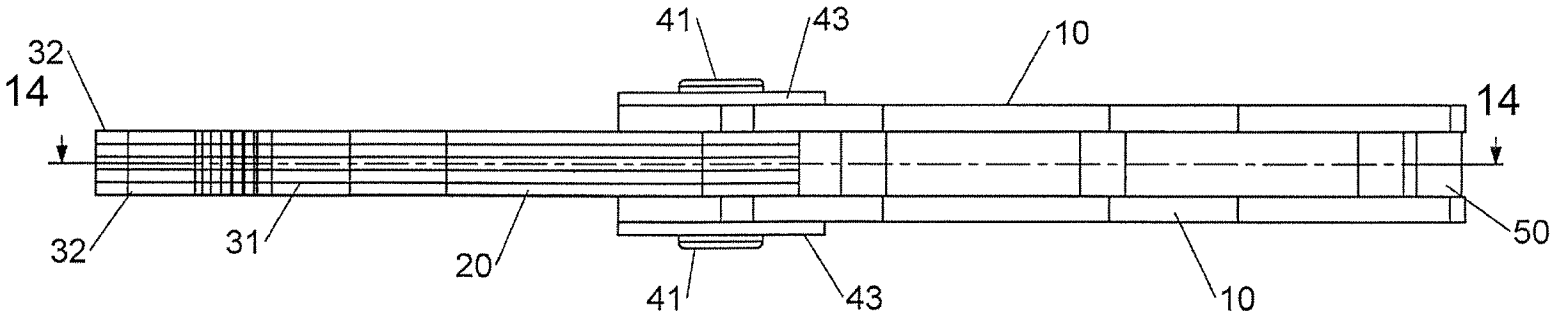
FIG. 13 shows a side view of the second embodiment of the jaw wrench of the present invention.
Figure 14:
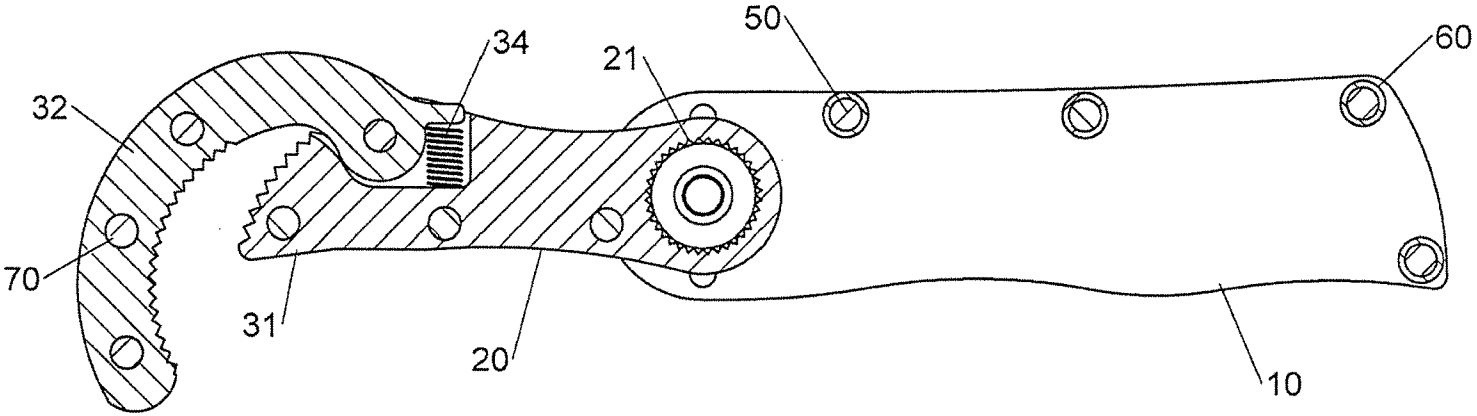
FIG. 14 is a cross sectional view, taken along line 14-14 of FIG. 13.

When assembling, as shown in FIGS. 13 and 14, the second toothed holes 21 of the third body 31 and the second body 20 are located corresponding to each other, and both of which are inserted between the two first bodies 10 and located corresponding to the first toothed holes 11. The fourth body 32 is pivotably connected to the second and third bodies 20, 31. The first resilient members 34 are respectively received in the second rooms 24. The first resilient member 34 is biased between the second and fourth bodies 20, 32. The four second fixing members 70 are connected to the plates of the second body 20 and the first installation units of the third body 31. The other three second fixing members 70 are connected to the second installation units of the plates of the fourth body 32 to form the combination as shown in FIG. 12.

Figure 15:
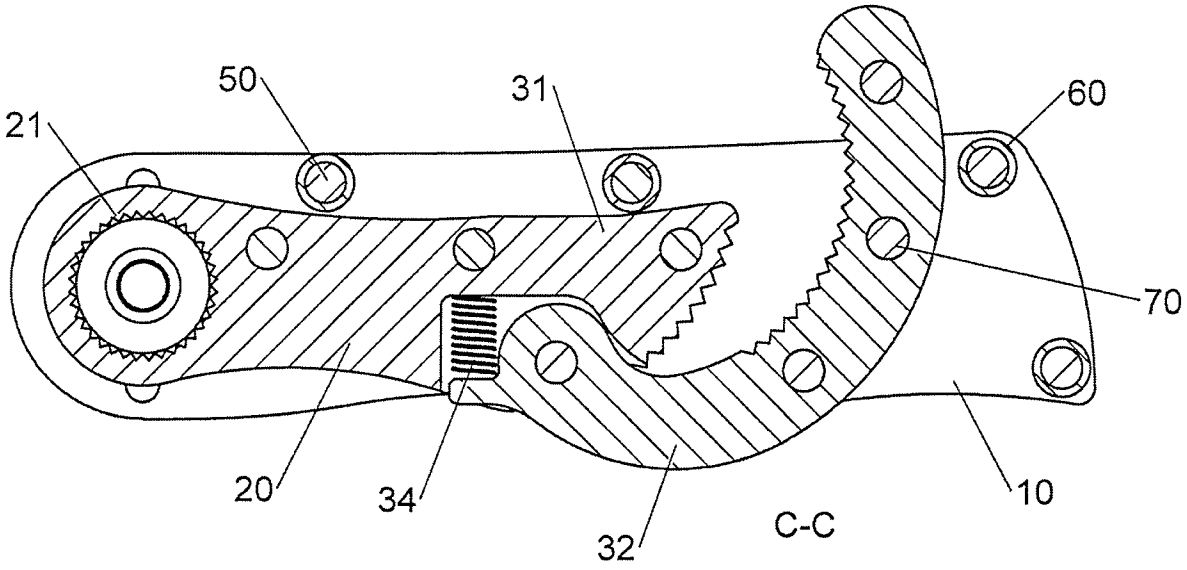
FIG. 15 is a partial cross sectional view of the folded second embodiment of the jaw wrench of the present invention.

As shown in FIG. 15, when the two control members 41 are pushed linearly and simultaneously, the third toothed holes 411 of the two control members 41 are engaged with the second toothed holes 21 of the second and third bodies 20, 31, so that the second body 20 can be pivoted to adjust the relative position between the first bodies 10, the second body 20 and the third body 31. The second body 20, the third body 31 and the fourth body 32 can be received in the first room 12.

Figure 16:
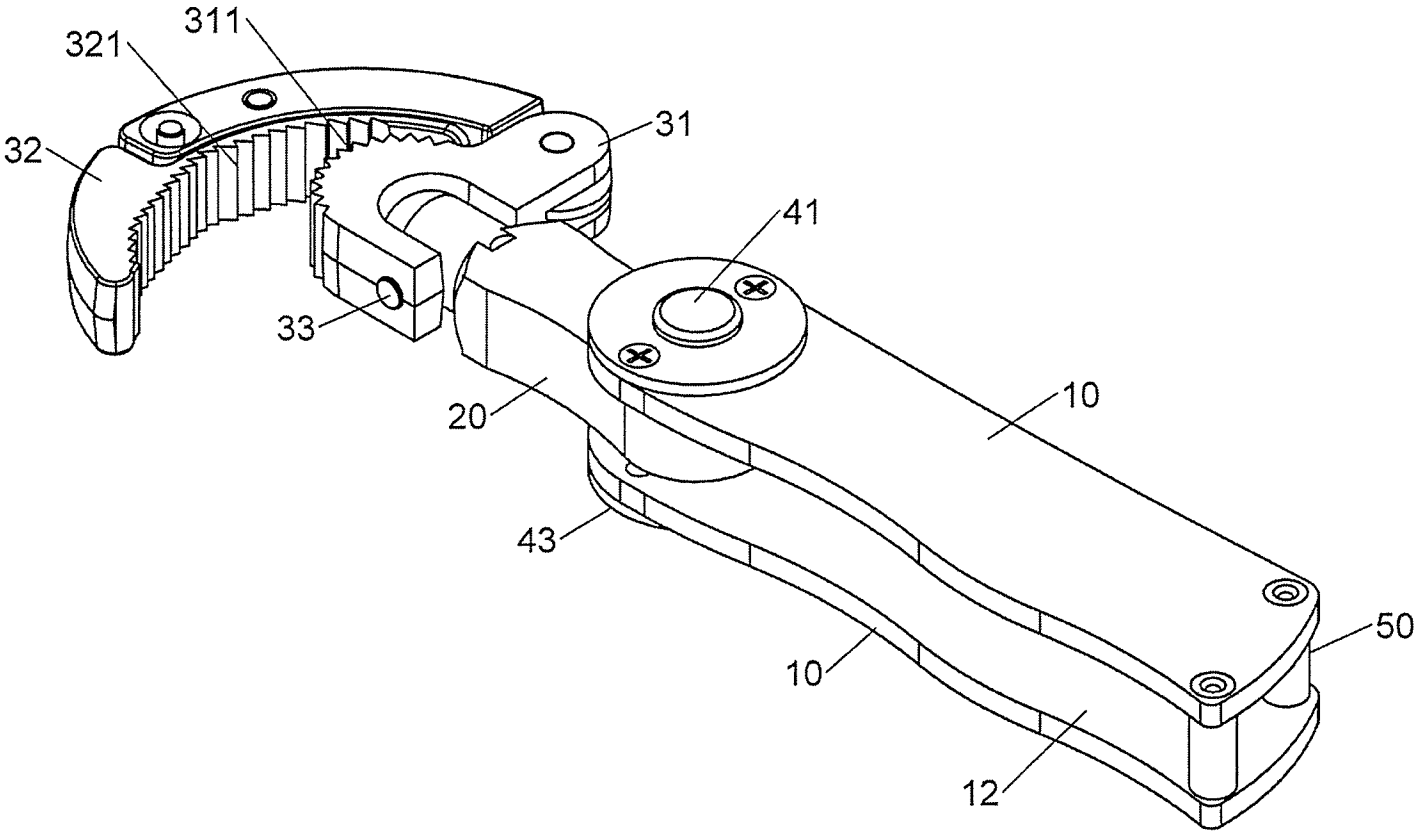
FIG. 16 is a perspective view to show the third embodiment of the jaw wrench of the present invention.

As shown in FIG. 16, this embodiment does not have the tubes 50 and the first fixing members 60, while the second body 20 and the function end unit 30 can be pivoted 360 degrees about the first toothed holes 11 of the first bodies 10.

The advantages of the present invention are that when the two control members 41 are pushed to move linearly, the second resilient members 42 are compressed, and each of the third toothed holes 411 is disengaged from the first toothed hole 11 corresponding thereto, and the second toothed hole 21 is still engaged with the third toothed holes 411. Therefore, the second body 20 can be pivoted to adjust the relative position between the first bodies 10 and the second body 20.

The two control members 41 have to be pushed simultaneously to perform the desired function, in other words, there are double safety features so that vibration of shaking of the jaw wrench cannot cause both of the control members 41 to be pushed.

The two control members 41 are biased by the second resilient members 42, when the two control members 41 are released, the second resilient members 42 push the control members 41 back to their initial positions.

Each of the first, second and third toothed holes 11, 21, 411 includes teeth arranged along a circular inner periphery thereof so that there are multiple positioned between the first bodies 10 and the second body 20 can be set. Assume that each of the first, second and third toothed holes 11, 21, 411 includes 36 teeth, there will be at least 24 positions between the first bodies 10 and the second body 20 can be set.

As shown in FIG. 9, the second body 20 and the function end unit 30 can be pivoted and received in the first room 12 between the first bodies 10 to save storage space needed.

The second body 20 is pivotably connected to the function end unit 30. The first pivotal portion 22 is pivotably connected to the second pivotal portion 312. The first pivotal hole 23 is pivotably connected to the second pivotal hole 313. The pin 33 extends through the first and second pivotal holes 23, 313, such that the function end unit 30 can be pivoted about the pin 33 relative to the second body 20 to set the relative position between the function end unit 30 and the second body 20.

While we have shown and described the embodiment in accordance with the present invention, it should be clear to those skilled in the art that further embodiments may be made without departing from the scope of the present invention.

What is claimed is:

1. A jaw wrench comprising:

two first bodies and each first body having multiple fixing holes, a first toothed hole defined in a first end of each of the first bodies, a first room defined between the two first bodies, two threaded holes located close to the first toothed hole;

a second body having a second toothed hole defined in a first end thereof, a first pivotal portion defined in a second end of the second body, the second toothed hole located between the two first bodies and located corresponding to the two respective first toothed holes, a number of each of the first toothed holes being the same as that of the second toothed hole, the first pivotal portion having a first pivotal hole, the two first bodies being symmetric relative to the second body;

a function end unit having a third body, a fourth body and a pin, the third body connected to the second body, the third body having a second pivotal hole, a second pivotal portion and a first toothed portion which is defined along a curved face, the second pivotal portion being pivotably connected to the first pivotal portion, the second pivotal hole being pivotably connected to the first pivotal hole, the third body being pivotable an angle relative to the second body about the second pivotal hole, the second pivotal hole communicating with the second pivotal portion, the fourth body having a first end thereof pivotably connected to a first end of the third body, the fourth body having a second toothed portion defined in a curved face, the second toothed portion facing the first toothed portion, the first toothed portion and the second toothed portion adapted to clamp an object therebetween, the pin extending through the first pivotal hole and the second pivotal hole to pivotably connect the second body to the function unit;

a control unit having two control members, a second resilient member, two covers and fourth screws, the two control members respectively received in the first and second bodies, the two control members located symmetric relative to the second body, each control member having a third toothed hole defined in an outside thereof, the third toothed holes engaged with the first and second toothed holes, each control member having a recess, the second resilient members received in the two respective recesses, the second resilient member biasing the third toothed hole of the control member corresponding thereto to be engaged with the first toothed hole/the second toothed hole, when the two control members are pushed to move linearly, the second resilient members are compressed, and each of the third toothed holes is disengaged from the first toothed hole corresponding thereto, and the second toothed hole is still engaged with the third toothed hole, the covers connected to the two first bodies and restricting the control members and the second resilient member, each cover having a first circular hole and two second circular holes, the two control members respectively and partially extending through the two first circular holes, each second circular hole located corresponding to one of the threaded holes, the two covers respectively located on two respective outsides of the two first bodies and symmetric to the second body, the screws extending through the second circular holes and threadedly connected to the threaded holes to fix the covers to the first bodies;

multiple tubes connected between the two first bodies so as to defined a first room between the two first bodies, each tube located corresponding to the fixing hole corresponding thereto, and multiple fixing members extending through the fixing holes of the first bodies and the tube to connect the two bodies to each other.

2. The jaw wrench as claimed in claim 1, wherein there are four fixing holes which are located along edges of the first body corresponding thereto.

3. The jaw wrench as claimed in claim 1, wherein the second body and the function unit are pivoted to be received in the first room when the control members are pushed to disengage the third toothed hole from the second toothed hole.

4. The jaw wrench as claimed in claim 1, wherein each of the second and third bodies is composed multiple plates.

5. The jaw wrench as claimed in claim 4, wherein one of the plates that is located at a middle of the second body includes a second room which is a recess, a first resilient member is received in the second room and biased between the second body and the fourth body.

6. The jaw wrench as claimed in claim 1, wherein the fourth body is composed of multiple plates and pivotably connected to the second and third bodies.

7. The jaw wrench as claimed in claim 6, wherein each of the second body and the third body has multiple first installation units, the first installation units are holes and located corresponding to each other, the fourth body has third pivotal holes which are located corresponding to one of the first installation units, each plate of the fourth body has three second installation units which are holes, the second installation units of the plates of the fourth body are located corresponding to each other, multiple second fixing members extend through the first installation units of the second body and the third body to connect the second body to the third body, multiple second fixing members are connected to the second installation units of each plate of the fourth body to connect the plates to form the fourth body, the second fixing members are rivets or threading members.

8. The jaw wrench as claimed in claim 1, wherein the second body and the function end unit are pivotable 360 degrees about the first toothed holes of the first bodies.

* * * * *